US007568765B2

(12) United States Patent
Bräuning

(10) Patent No.: US 7,568,765 B2
(45) Date of Patent: Aug. 4, 2009

(54) CHAIR

(75) Inventor: Egon Bräuning, Weil am Rhein (DE)

(73) Assignee: Vitra Patente AG, Muttenz (CH)

( * ) Notice: Subject to any disclaimer, the term of this patent is extended or adjusted under 35 U.S.C. 154(b) by 214 days.

(21) Appl. No.: 10/592,569

(22) PCT Filed: Oct. 3, 2005

(86) PCT No.: PCT/CH2005/000572

§ 371 (c)(1),
(2), (4) Date: Sep. 12, 2006

(87) PCT Pub. No.: WO2007/038879

PCT Pub. Date: Apr. 12, 2007

(65) Prior Publication Data

US 2008/0231095 A1 Sep. 25, 2008

(51) Int. Cl.
*A47C 7/36* (2006.01)
*A47C 7/00* (2006.01)

(52) U.S. Cl. ..... 297/354.1; 297/396; 297/440.2; 297/452.13

(58) Field of Classification Search ..... 297/396, 297/354.4, 354.11, 452.13, 452.15, 440.2
See application file for complete search history.

(56) References Cited

U.S. PATENT DOCUMENTS 6,257,665 B1 * 7/2001 Nagamitsu et al. ..... 297/285
6,709,060 B1 * 3/2004 Su ..... 297/440.2
7,014,269 B2 * 3/2006 Coffield et al. ..... 297/452.56
7,347,496 B1 * 3/2008 Wang ..... 297/383
2007/0057556 A1 * 3/2007 Kang ..... 297/354.1

FOREIGN PATENT DOCUMENTS

DE 10 2004 012850 A1 5/2005
EP 0 970 639 A 1/2000
EP 1 039 816 B1 10/2000

OTHER PUBLICATIONS

Written Opinion issued by the ISA in connection with International Patent Appln. No. PCT/CH2005/000572.
International Search Report issued by the ISA in connection with International Patent Appln. No. PCT/CH2005/000572.

* cited by examiner

*Primary Examiner*—Sarah McPartlin
(74) *Attorney, Agent, or Firm*—McCarter & English, LLP

(57) ABSTRACT

The chair has a sub frame (1) set on the floor, a mechanism (2) set on the sub frame, a seat (3) set on the mechanism (2) and a backrest (7) attached to the mechanism (2). The backrest (7) exhibits a backrest frame (5), which supports an elastically deformable backrest part (6) with a back panel (62). The back panel (62) has a back part (60), to which a head restraint (61) is attached. The backrest (7) is capable of pivoting about a first pivot shaft (D1) from an essentially upright, neutral position to a reclined position displaced towards the rear. The movements of the seat (3) and the backrest (7) are synchronized with one another. In the event of the elastic deformation of the back part (60) into a free space for the backrest frame (5), by the application of a force in the direction of the reclined position having an essentially concave tendency to the back of the user, means (53,67,D4;55,610,D5) are provided for an opposing raising of the shoulder area, as a transitional zone of the back part (60) for the head restraint (61), and of the head restraint (61).

9 Claims, 18 Drawing Sheets

$B_0$
61
D5
7
6
60
51
D4
53,67
3
$S_0$
5
23
D3
2
$R_0$
D2
D1
1
V

Fig. 3G
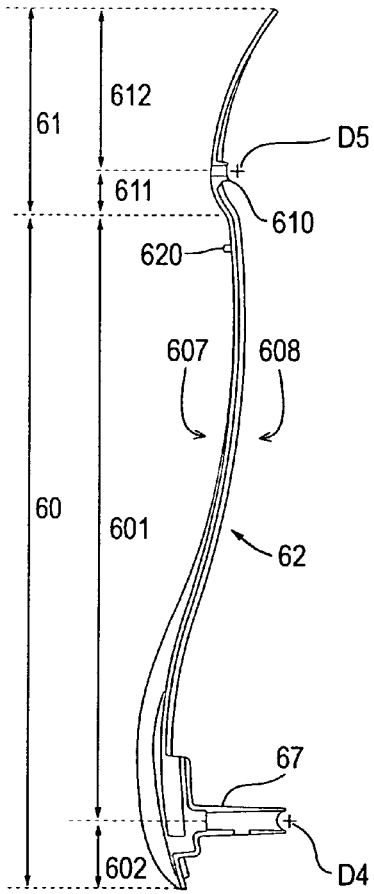
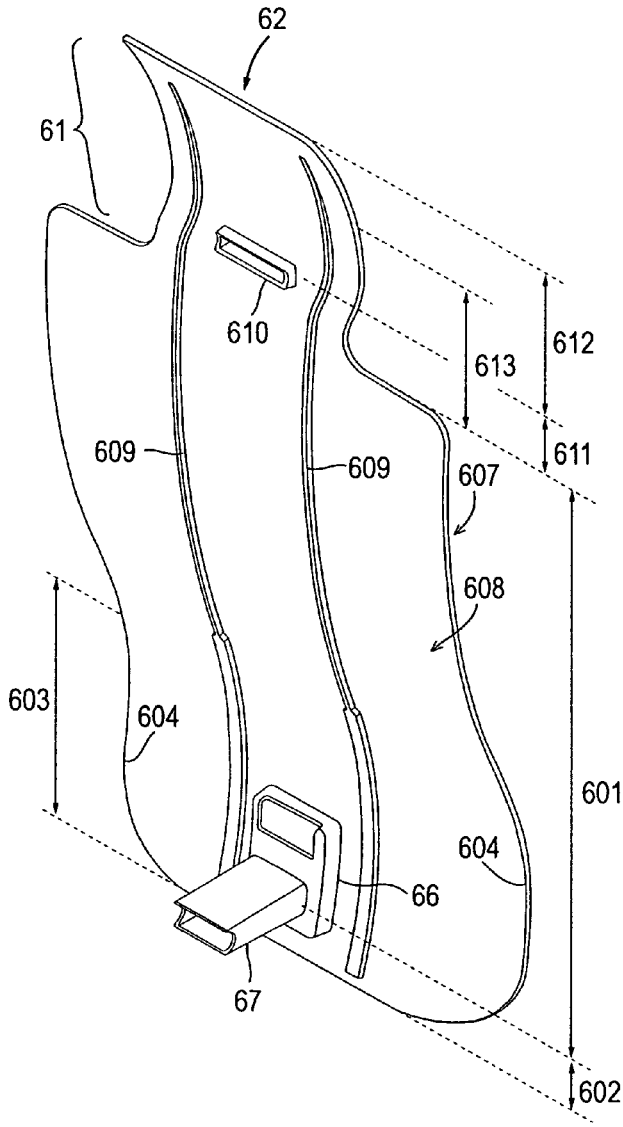
Fig. 3F

Fig. 3L
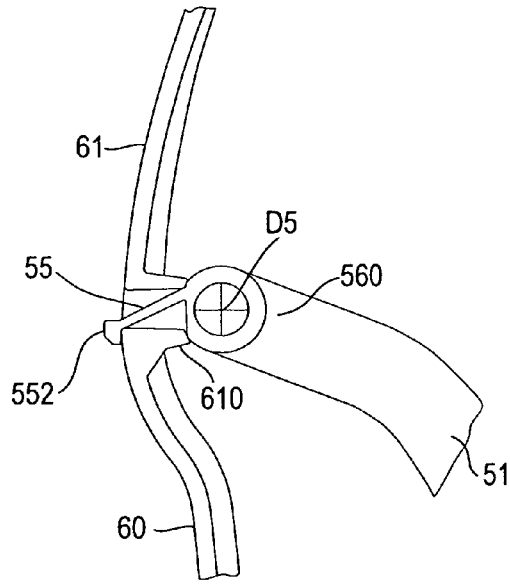
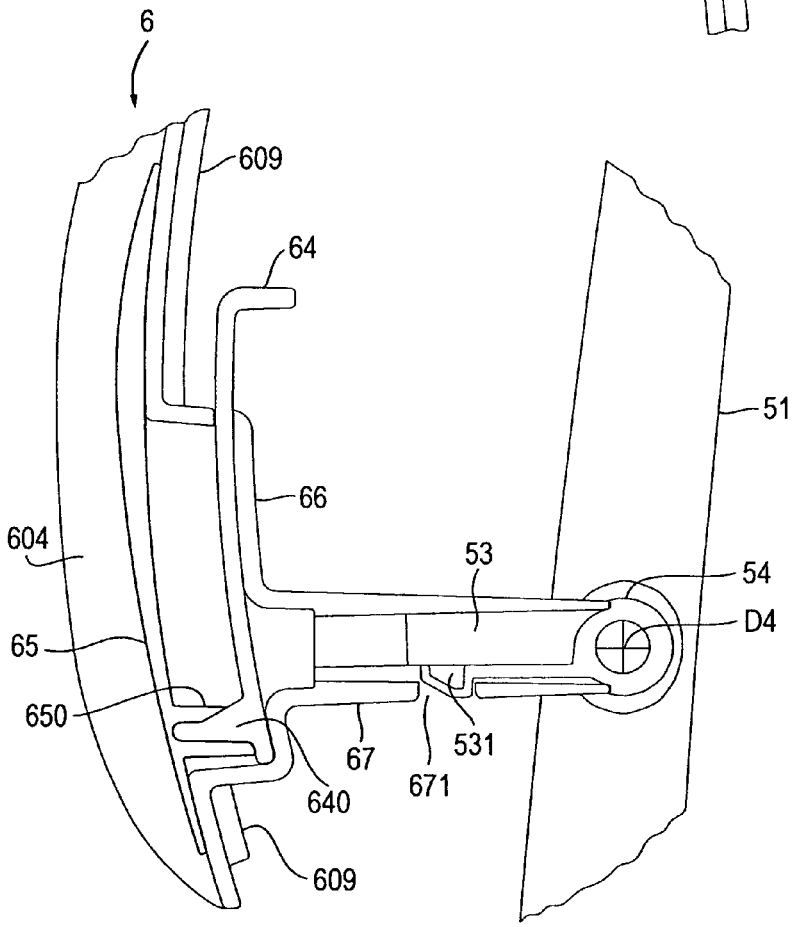
Fig. 3K

CHAIR

AREA OF APPLICATION OF THE INVENTION

The present invention relates to a chair of the kind having a sub frame set on the floor, a mechanism set on the sub frame, a seat set on the mechanism and a backrest attached to the mechanism. The backrest exhibits a backrest frame, which supports an elastically deformable backrest part with a back panel, which back panel has a back part to which a head restraint is attached. The backrest is capable of pivoting about a first pivot shaft from an essentially upright neutral position to a reclined position displaced towards the rear. The movements of the seat and the backrest are synchronized with one another.

STATE OF THE ART

A chair of the aforementioned kind is previously disclosed, for example, in EP 1 039 816 B1.

OBJECT OF THE INVENTION

Based on the previously disclosed state of the art in this respect, the object of the invention is to propose a chair of the previously defined kind with a perfected ergonomic function. When the backrest is in the reclined position displaced towards the rear, the support for the shoulder area and the head of the user should be improved in particular.

DESCRIPTION OF THE INVENTION

The chair has a sub frame set on the floor, a mechanism set on the sub frame, a seat set on the mechanism and a backrest attached to the mechanism. The backrest exhibits a backrest frame, which supports an elastically deformable backrest part with a back panel. The back panel has a back part, to which a headrest is attached. The backrest is capable of pivoting about a first pivot shaft from an essentially upright neutral position to a reclined position displaced towards the rear. The movements of the seat and the backrest are synchronized with one another. In the event of the elastic deformation of the backrest part into a free space for the backrest frame, by the application of a force in the direction of the reclined position having in principle a concave tendency to the back of the user, means are provided for an opposing raising of the shoulder area, as a transitional zone of the back part for the head restraint, and of the head restraint.

The following characteristics relate to special embodiments of the invention: the back part and the head restraint of the back panel blend uniformly into one another. The head restraint is divided into a lower, first head section, which fits onto the back part, and an upper, second head section, which first head section forms a neck area together with a neighboring part of the second head section. A fourth docking part is provided in the neck area. The back part is divided into an upper, first back section, which fits onto the neck area, and a lower, second back section, which second back section forms a lumbar area together with a neighboring part of the first back section. A second docking part is provided in the lumbar area.

A fourth pivot shaft first extends through the backrest frame, which shaft lies on a level with the lumbar area in the vertical sense, and on which a first preformed part is linked to a first docking part, which first docking part is attached to the second docking part. A fifth pivot shaft also extends through the backrest frame, which shaft lies on a level with the neck area in the vertical sense and on which a second preformed part is articulated with a third docking part, which third docking part is attached to the fourth docking part. The backrest frame is rigid and consists of two lateral braces, in each case with a prolongation on their lower ends and connections between the lateral braces. The first connection is a transverse strut arranged close to the prolongations. The second connection is a central transverse brace, through which the fourth pivot shaft extends with the first preformed part articulated with it. The third connection is an upper transverse strut, through which the fifth pivot shaft extends with the second preformed part articulated with it.

The transverse strut in each case consists of a connecting piece extending from the associated lateral brace and a bridging piece, which engages into both of the mutually aligned connecting pieces. The central transverse brace in each case consists of a connecting piece extending from the associated lateral brace and an axle rod, which engages into both of the mutually aligned connecting pieces and carries the first preformed part. The upper transverse brace in each case consists of a prolongation extending from the associated lateral brace in each case and an axle rod, which engages into both of the mutually aligned prolongations and carries the second preformed part. The first docking part and the second docking part, and the third docking part and the fourth docking part, are detachably attached to one another by means of locking devices. The first docking part and the third docking part are embodied as push-in elements. The second docking part and the fourth docking part are embodied as sleeves, which extend from the rear side of the back panel. A lumbar support that is capable of vertical displacement is arranged in the lower area of the back panel on its front side. Strengthening ribs and a cell to accept an adjusting lever for the adjustment of the lumbar support are provided on the rear side of the back panel. Vertical slots for guiding the lumbar support are present on the front side of the back panel, which vertical slots follow the course of the strengthening ribs and extend over the lumbar area.

The mechanism consists of a fixed base set on the sub frame and a seat carrier attached to the base. The attachment between the base and the seat carrier is initially effected on the first fixed pivot shaft and on a second moving pivot shaft, which faces towards the rear edge of the seat. Finally, the base and the seat carrier are attached to a third moving pivot shaft, which faces towards the front edge of the seat. A prolongation of the backrest frame in each case is attached to a frame connection in each case, which is articulated with the first pivot shaft on the one hand and with the second pivot shaft on the other hand. In the mechanism, a spring subassembly generates a pretension, which endeavors to retain the backrest in the upright neutral position.

The back panel consists of plastic. The lumbar area of the back panel possesses outer flanks with a tendency to engage in principle around the thigh area of the user. The head restraint exhibits a curvature in its vertical cross section with a tendency to present an essentially convex surface to the user. The fifth pivot shaft lies in the direction of the front edge of the seat ahead of the upper edge of the head restraint and ahead of the fourth pivot shaft. The back panel is enclosed by a covering, preferably by a plastic foam material. The covering is covered by a cover, in conjunction with which the cover for the head restraint preferably takes the form of a separate, replaceable part.

BRIEF DESCRIPTION OF THE ACCOMPANYING DRAWINGS

In the drawings:

FIG. 3F depicts the back panel in FIG. 3E as a perspective view from the rear, with subdivision into sections;

FIG. 3G depicts the back panel in accordance with FIG. 3F as a perspective view from the side, with subdivision into sections;

FIG. 3K depicts an enlarged view of the detail X1 in FIG. 3B; and

FIG. 3L depicts an enlarged view of the detail X2 in FIG. 3B.

ILLUSTRATIVE EMBODIMENT

Figure 1A:
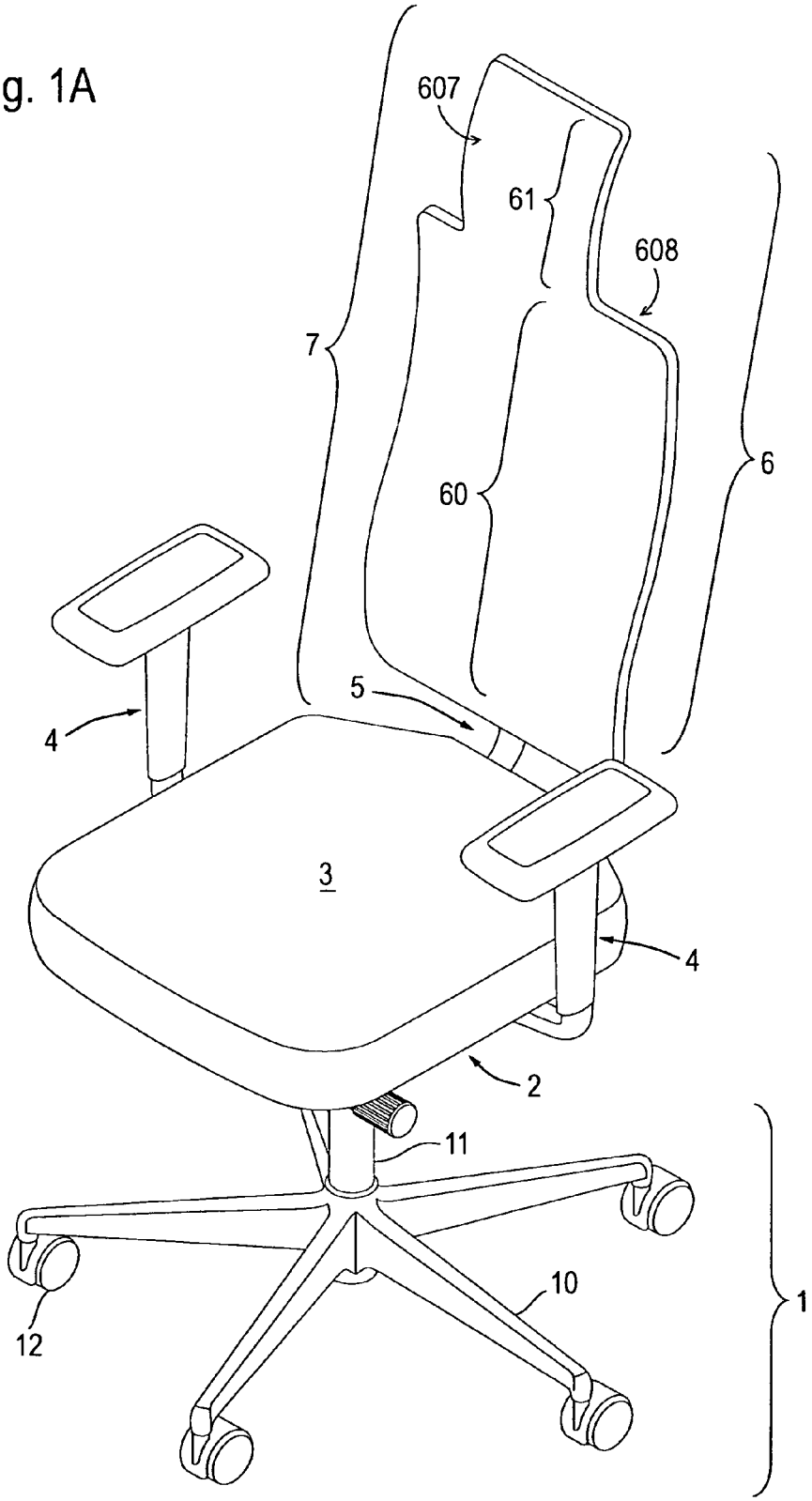
FIG. 1A depicts a perspective view from the front of a chair in accordance with the invention in the form of an office swivel chair with arm rests, in an upright neutral position.
Figure 1B:
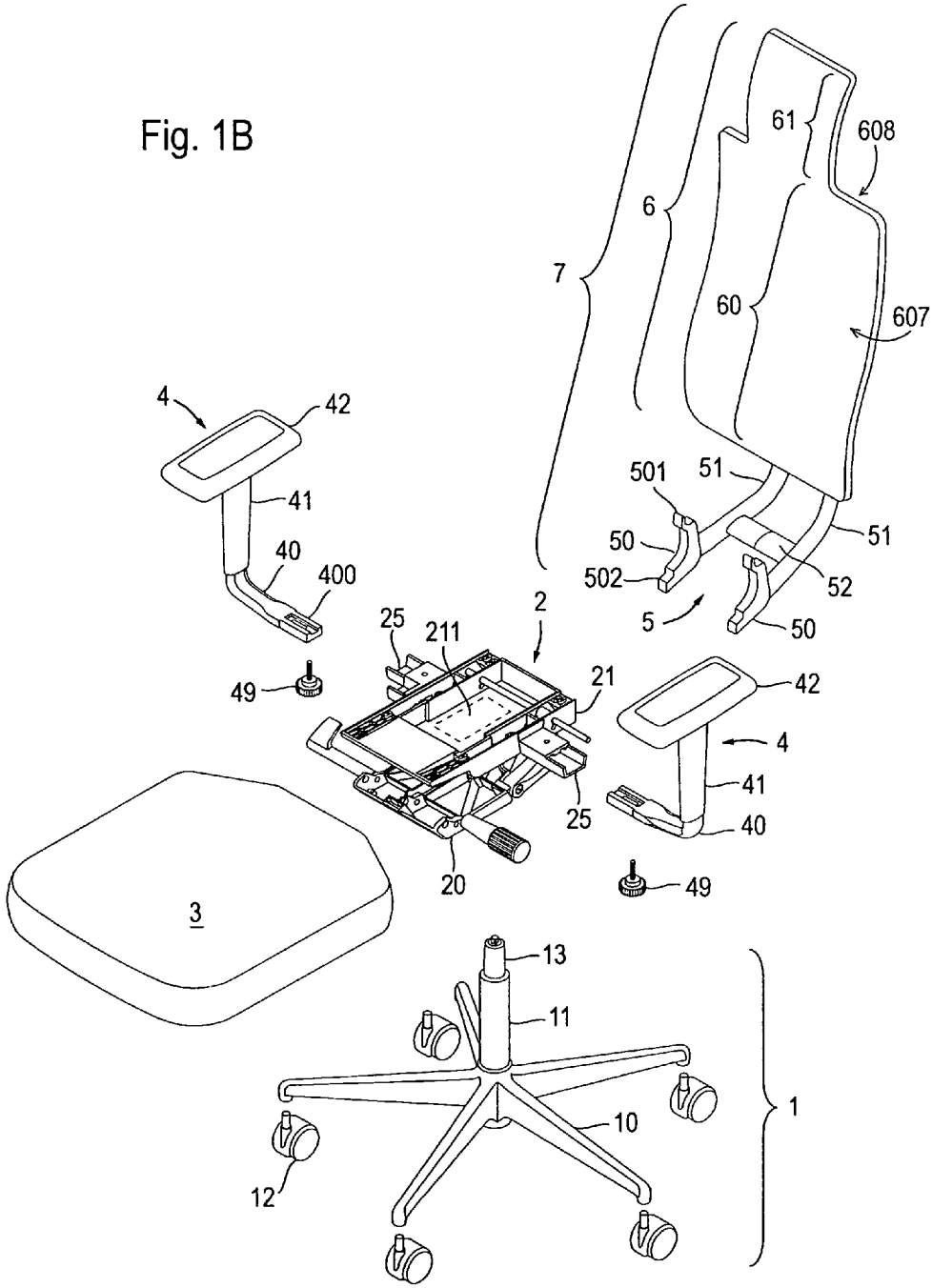
FIG. 1B depicts a perspective exploded view of the essential component parts of the chair in accordance with FIG. 1A.
Figure 1C:
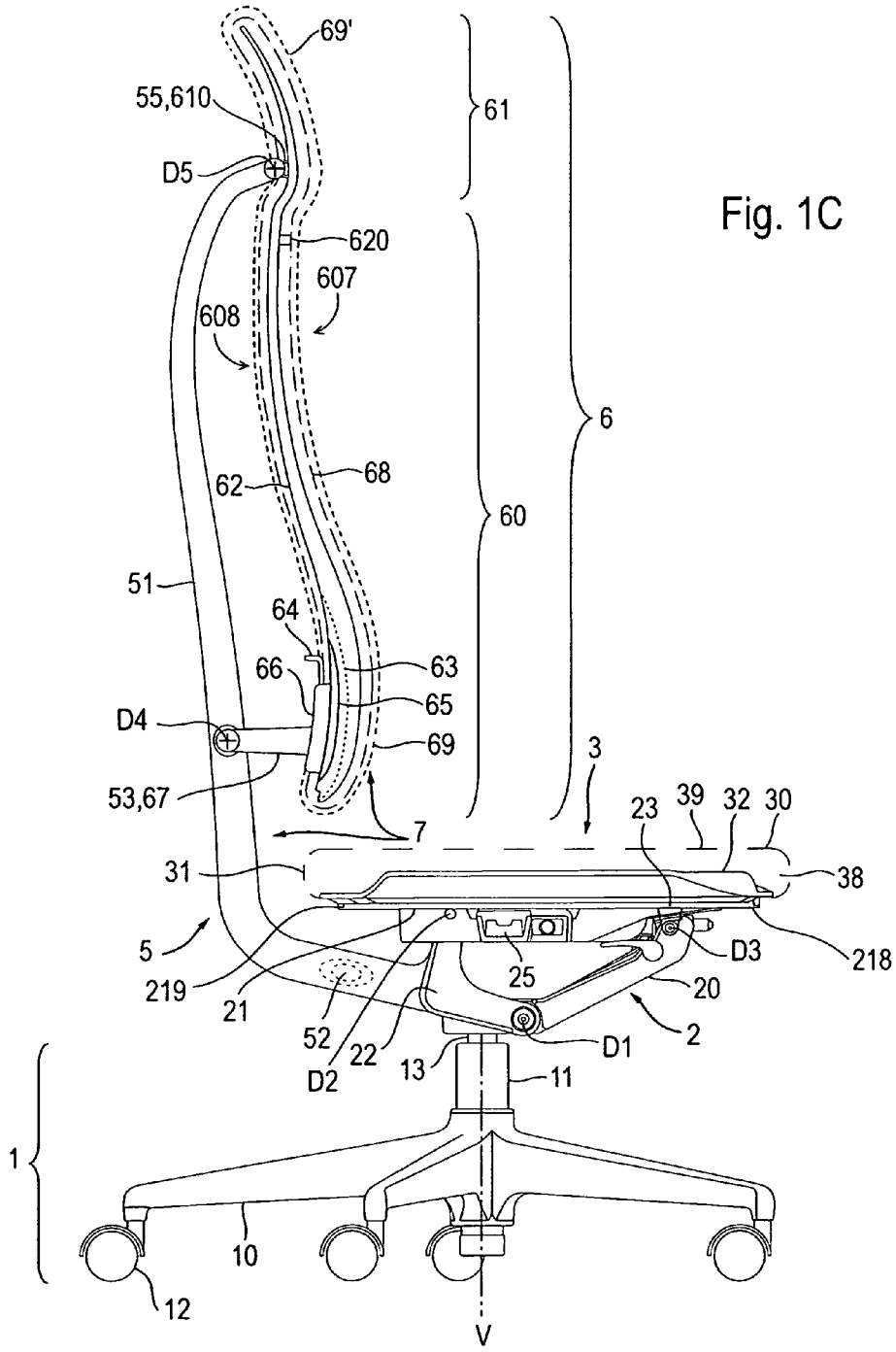
FIG. 1C depicts a side view of the chair in accordance with FIG. 1A, without arm rests, in the neutral position.
Figure 1D:
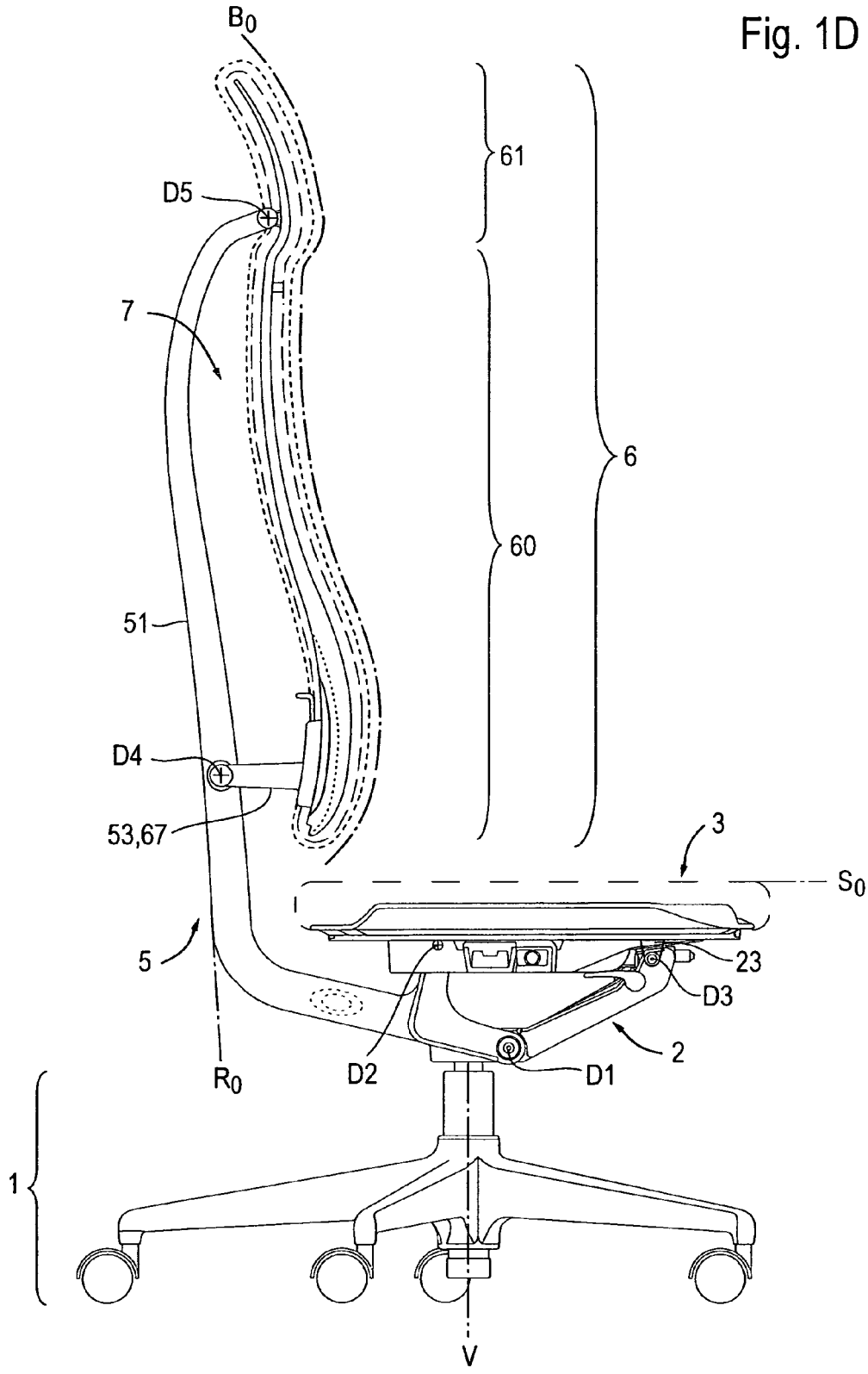
FIG. 1D depicts the representation in accordance with FIG. 1C with positional indications for the seat, the backrest and the backrest part.

A detailed description of an illustrative embodiment of a chair in accordance with the invention is provided below with reference to the accompanying drawings.

The following statement applies to the rest of the description in its entirety. If reference designations are contained in a Figure in the interests of greater graphical unambiguity, but if these are not explained in the text of the description immediately associated therewith, reference is made to their mention in the preceding description of the Figures. In the interests of greater clarity, the repeated designation of component parts is dispensed with for the most part in the following Figures, to the extent that it is graphically unambiguous that these are "recurring" component parts.

FIGS. 1A to 1D

A comfortable office swivel chair basically consists of the sub frame 1 set on the floor, the mechanism 2 reposing thereon, on which the seat 3 is assembled, a backrest 7 and preferably adjustable arm rests 4. The sub frame 1 typically exhibits a foot 10—for example a 5-star foot—which reposes on floor elements 12, preferably rollers. For the purpose of adjusting the level of the seat 3 and its simultaneous suspension, a spring-assisted vertical pneumatic cylinder 13 arranged centrically in an upright tube 11 is inserted into the foot 10, which cylinder supports the mechanism 2, which consists of a fixed base 20 and the pivoting seat carrier 21. The backrest 7 is subdivided into a backrest frame 5 and a backrest part 6, which is structured in the form of the back part 60 and the head restraint 61 attached above it. The front side 607 and the rear side 608 are defined on the backrest part 6. The swivel chair can be caused to pivot about the vertical axis of rotation V through 360° as a rule, and in the unloaded condition it remains in the upright, neutral position, which is determined by the pretensioning of the spring subassembly 211 in the mechanism 2 and is limited by a stop in the direction of its forward inclination.

The upright, neutral position is defined by the following positions:

Seat 3: position $S_0$, i.e. the surface of the seat 3 is at least horizontal in principle;

Backrest frame 5: position $R_0$, i.e. the lateral braces 51 of the backrest frame 5 are standing with their main sections vertical in principle;

Backrest part 6: position $B_0$, i.e. the backrest part 6 with the back part 60 and the head restraint 61 are standing vertically in principle and as such are complementary to the upright seated position of a user.

The backrest frame 5 consists of two yoke-shaped, repeatedly bent lateral braces 51, each of which is secured to the mechanism 2 at the bottom to a frame attachment 22 executed as an angle piece. The frame attachments 22 are articulated on the one hand with a first pivot shaft D1, which is present on the fixed base 20, and on the other hand with a second pivot shaft D2, on the rear part of the pivoting seat carrier 21. Present on the base 20 above the first pivot shaft D1 and closer to the front edge 30 of the seat 3 is a fixed third pivot shaft D3, to which two brackets 23 are connected, which on the other hand run in a link guide 212. Present to the side of the seat carrier 21 in each case is a locating connecting piece 25, in order, in the case of the desired fitment of armrests 4 to the chair, to permit their attachment thereto. A spring subassembly 211 intended to produce the return force for the mechanism 2 is arranged in a recess in the seat carrier 21. The front part 218 and the rear part 219, which lie adjacent to the front edge 30 of the seat and the rear edge 31 of the seat, are defined on the seat carrier 21.

Both lateral braces 51 are attached to one another by means of a composite transverse strut 52 adjacent to the frame attachments 22. At its bottom end, each lateral brace 51 is provided with a prolongation 50 embodied in principle as an angle piece. Every prolongation 50 possesses a first retaining contour 501 and a second retaining contour 502. Articulated above the seat 3 between the two lateral braces 51 in a fourth pivot shaft D4 is a first docking part 53, which is connected to a second docking part 67, which joins onto a cell 66, which lies on the rear side 608 of the back panel 62 of the backrest part 6. Inserted into the cell 66 is an adjusting lever 64, by means of which a panel-shaped lumbar support 65 arranged on the front side 607 of the back panel 62 is capable of limited vertical displacement. The fifth pivot axis D5 with the third docking part 55 articulated therein passes through the upper ends of both lateral braces 51, which third docking part is connected to a fourth docking part 610, which extends from the rear side 608 of the lower area of the head restraint 61 of the back panel 62. Beneath the fifth pivot shaft D5, the back panel 62 possesses securing elements 620 to permit the attachment thereto of a replaceable covering 69' for the head restraint 61.

Internally, the backrest part 6 has the elastic back panel 62, which is surrounded by a covering 68, which preferably consists of a plastic foam material. Externally, the backrest part 6 is covered by a cover 69—for example made of knitted fabric, leather, or similar—so that the inner covering 68 is not visible. In order to maintain the displacement of the lumbar support 65 after covering with foam, the lumbar support is lined beforehand with a separating film 63. A constituent part of the seat 3 is a seat panel 32 attached to the seat carrier 21, which seat panel has upholstery 38 on the top, which is provided with a cover 39 extending at least from the front edge 30 as far as the rear edge 31. An arm rest 4 consists of a supporting arm 40 bent at an angle, a sleeve piece 41 enclosing the vertical branch of the supporting arm 40 and the arm support 42. For the vertical adjustment of the arm support 42, the sleeve piece 41 can be displaced telescopically on the vertical branch and, for example, can be arrested in steps. The free end of the horizontal branch of the supporting arm 40 is provided as a sliding block 400 with an elongated hole, so that after releasing the clamping screws 49, width adjustment is possible between the two arm rests 4 on the chair.

Figure 1E:
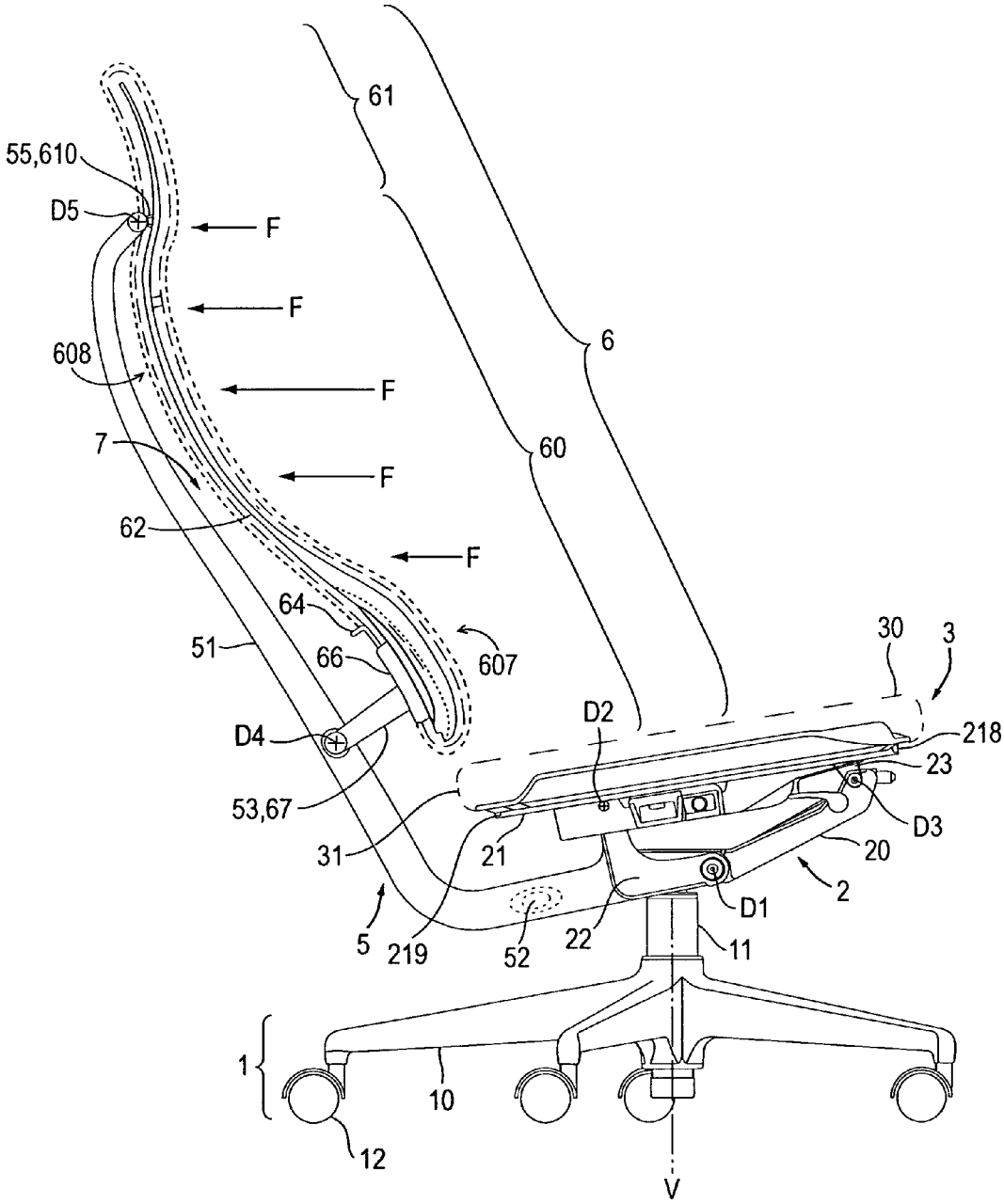
FIG. 1E depicts a side view of the chair in accordance with FIG. 1A, without arm rests, in the maximum reclined position.
Figure 1F:
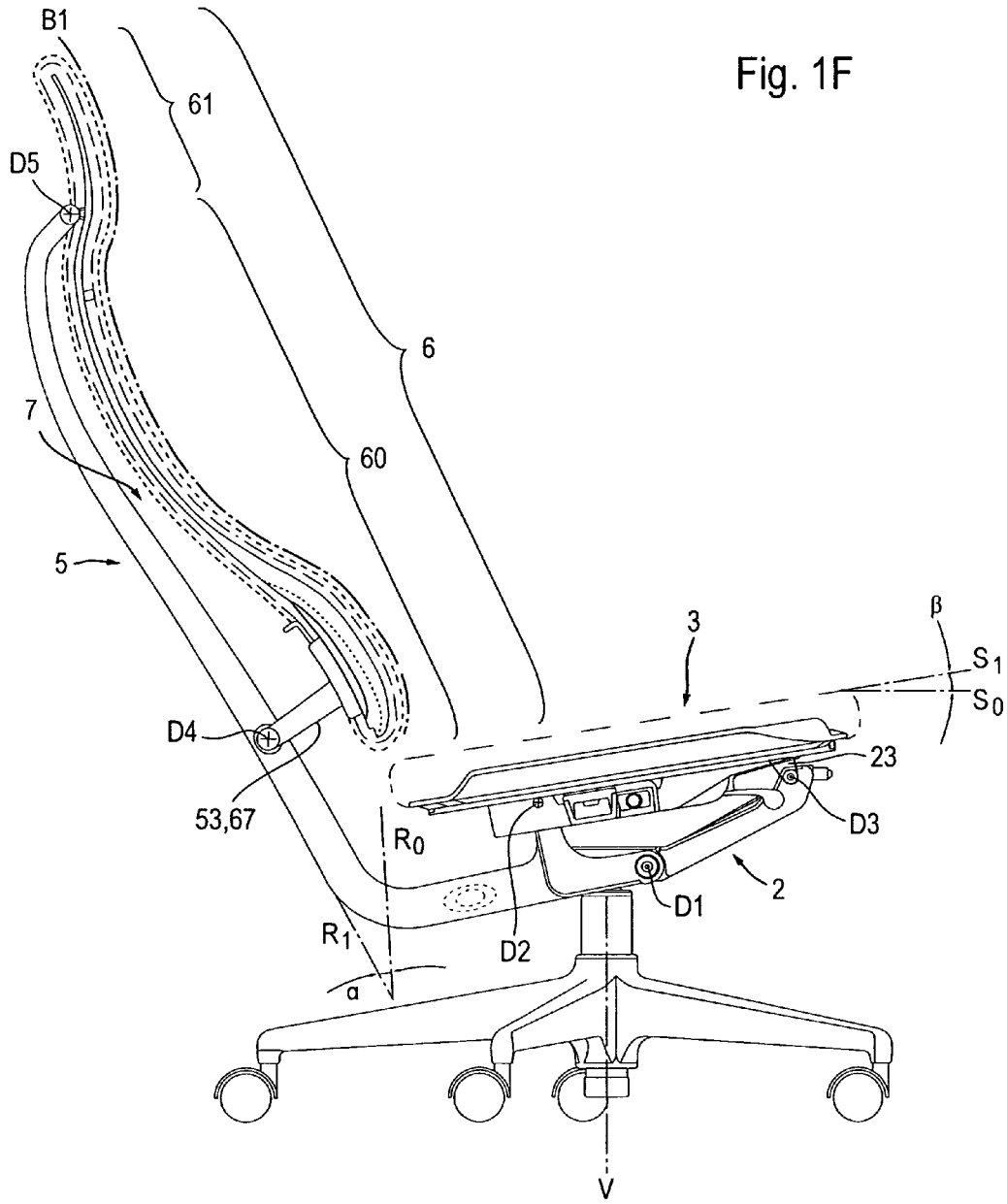
FIG. 1F depicts the representation in accordance with FIG. 1E, with positional indications for the seat, the backrest and the backrest part.

FIGS. 1E and 1F

If a user seated on the chair transfers his body weight rearwards from the forward-inclined writing position or the upright sitting position and, by so doing, exerts a sufficient all-over compressive force F on the backrest part 6, the compressive loading will be introduced onto the backrest frame 5 and will cause the backrest 7 as a whole to be displaced as far as the maximum reclined position, against the force of the spring subassembly 211 in the mechanism 2. As it is lowered towards the rear, the backrest frame 5, which is articulated on the first pivot shaft D1, draws the rear part 219 of the pivoting seat carrier 21 downwards and rearwards via the moving frame attachments 22, which are articulated on the second pivot shaft D2. At the same time, the brackets 23 that are articulated on the third pivot shaft D3, which otherwise run in the link guides 212 of the seat carrier 21 in the direction of its front part 218, are caused to pivot. The connections formed by the first and second docking parts 53,67, and by the third and fourth docking parts 55,610, are caused to pivot towards one another about the associated fourth pivot shaft D4 and fifth pivot shaft D5, in each case by the inward deformation of the backrest part 6 with the internally arranged back panel 62, as a consequence of the exerted compressive force F. Supported free space for the shoulder area of the user is provided in this way, and opposing raising of the head restraint 61 for the inclined lowering of the backrest 7 is provided at the head restraint 61.

The maximum reclined position is defined by the following positions:

Seat 3: position $S_1$, i.e. the surface of the seat 3 has moved from the initial position $S_0$ to the seat angle $\beta$ with a raised front edge 30 and a lowered rear edge 31;

Backrest frame 5: position $R_1$, i.e. the lateral braces 51 of the backrest frame 5 have moved from the initial position $R_0$ with their main sections to the backrest angle $\alpha$;

Backrest part 6: position $B_1$, i.e. the entire backrest part 6 has been lowered at an angle towards the rear, and at the same time the lowest section of the back part 60 has moved closer to the lowered rear edge 31 of the seat 3, and the section of the back part 60 situated between the pivot shafts D4,D5 has deformed inwards and moved closer to the lateral braces 51 and in so doing has raised the head restraint 61.

Figure 2A:
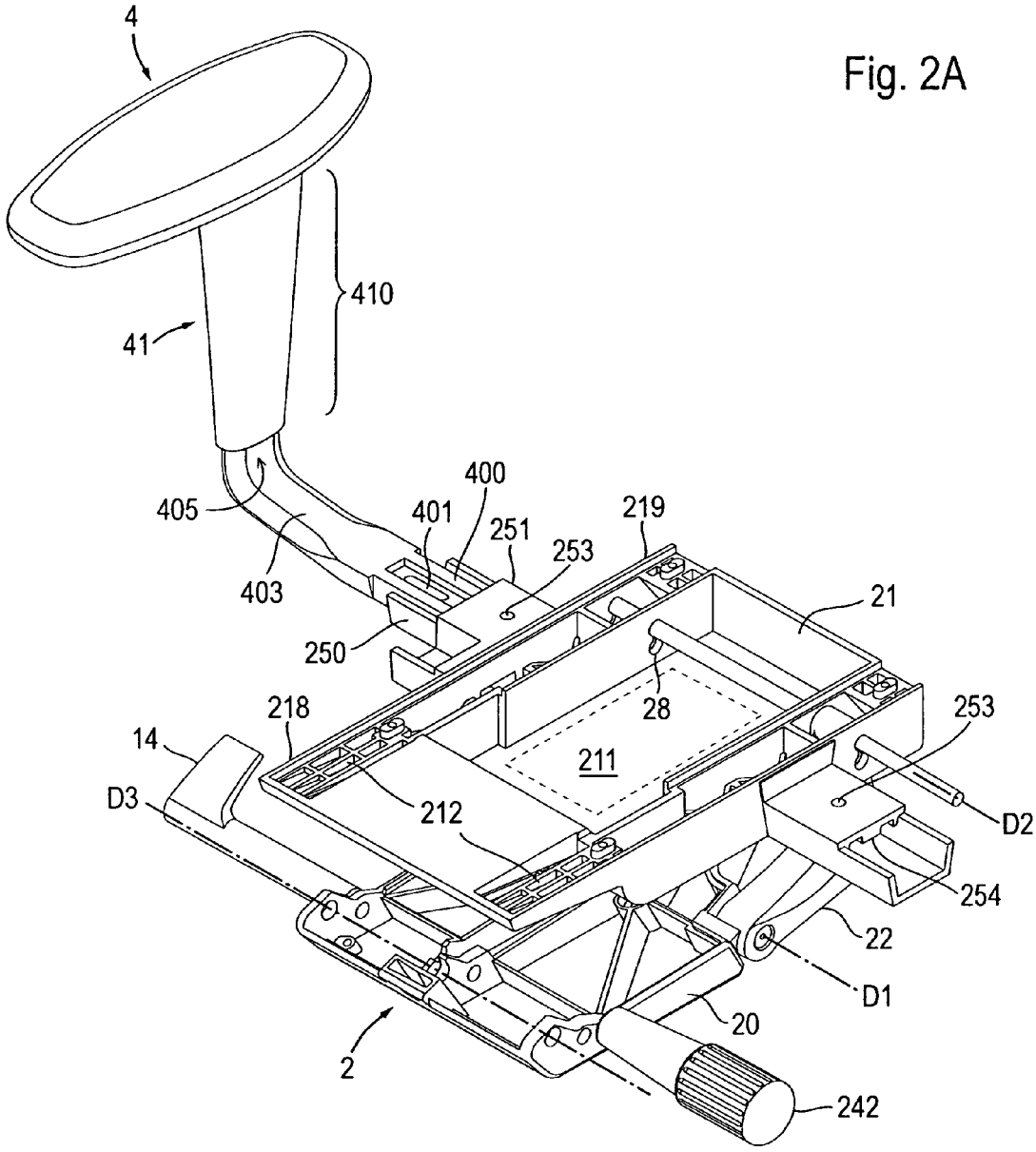
FIG. 2A depicts a front perspective view from above of the mechanism in FIG. 1B, with an arm rest attached on one side.
Figure 2B:
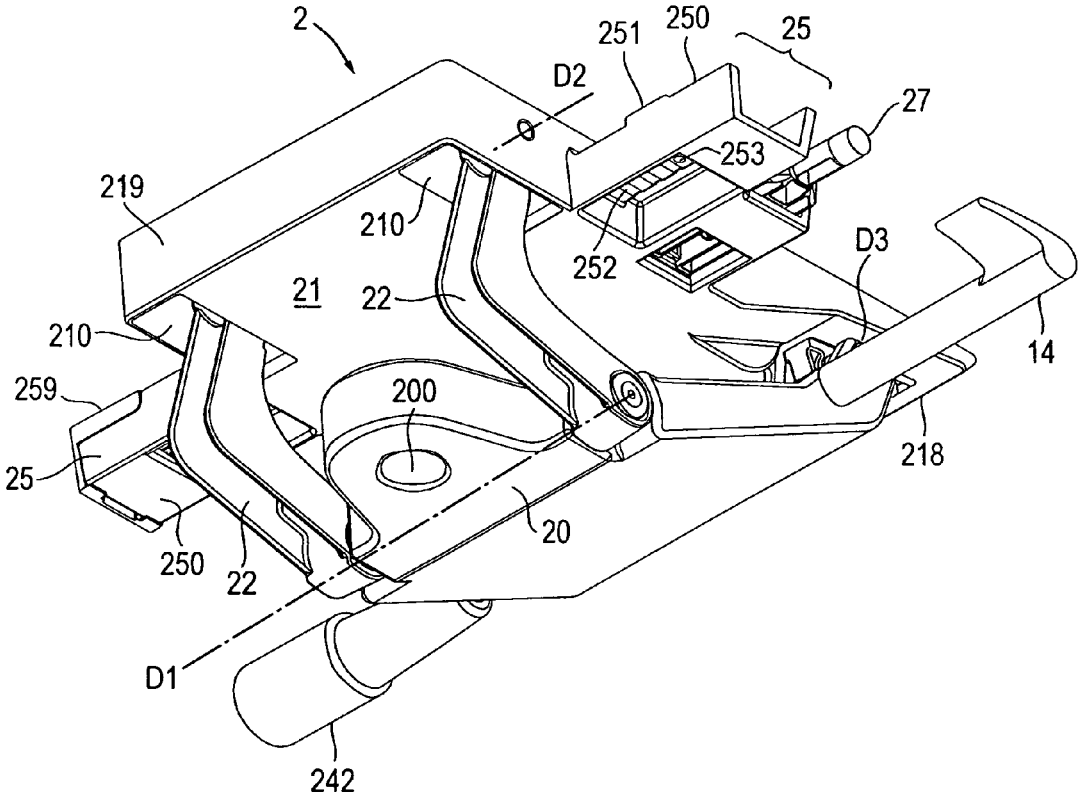
FIG. 2B depicts a rear perspective view from below of the mechanism in FIG. 1B, with a cap attached on one side.

FIGS. 2A and 2B

A recess 28 for the forward inclination of the seat 3 is provided on the mechanism 2 beneath the second pivot shaft D2 in the seat carrier 21. The adjusting lever 14 is used to activate the spring-assisted vertical pneumatic cylinder 13, the adjusting device 242 enables the pretensioning of the spring subassembly 211 to be set, and the adjusting element 27 is actuated for the adjustment of the seat depth. The locating connecting pieces 25 have a first and a second segment 250,251 to engage around the push-in sliding piece 400, which represents the end of the horizontal branch 403 of the supporting arm 40. An elongated hole 401 is present in the sliding piece 400 to permit the adjustment of the width. The threaded shaft of the clamping screw 49 engages in an internally threaded hole 253 in the second segment 251, which possesses a locking means 252 on the underside for the better securing of the inserted sliding piece 400. The shaft 410 of the sleeve piece 41 of the arm rest 4 is installed above the vertical branch 405 of the supporting arm 40. If it is not wished to fit any arm rests 4, the locating connecting piece 25 is closed with a cover 259 for aesthetic reasons. An opening 200 is provided in the base 20 to facilitate its engagement with the spring-assisted vertical pneumatic cylinder 13. A bearing recess 210 is let into the seat carrier 21 in each case in the area of the second pivot shaft D2 to permit docking of the prolongations 50 on the backrest frame 5 with the frame attachments 22.

Figure 2C:
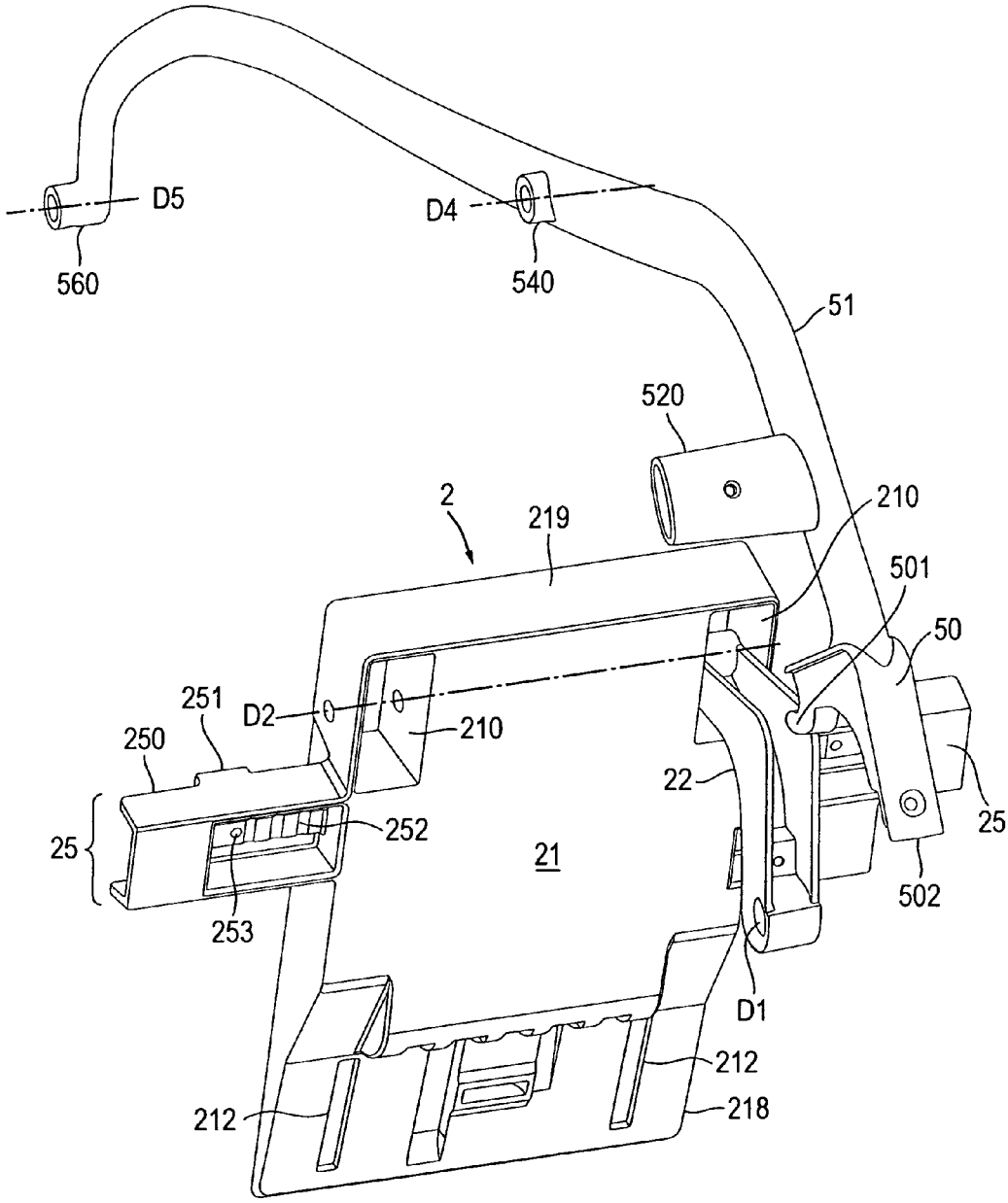
FIG. 2C depicts a representation in principle as a rear perspective view from below showing the pivoting seat carrier of the mechanism in accordance with FIG. 1B, and with a lateral brace of the backrest frame in the vicinity.
Figure 2D:
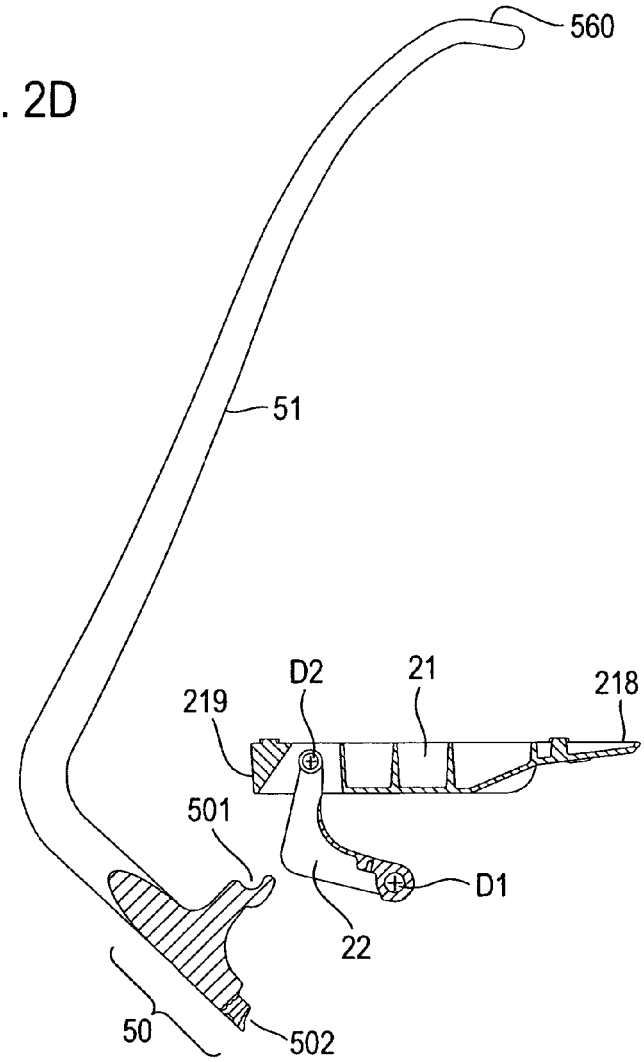
FIG. 2D depicts the representation in principle in accordance with FIG. 2C as a vertical partial section.
Figure 2E:
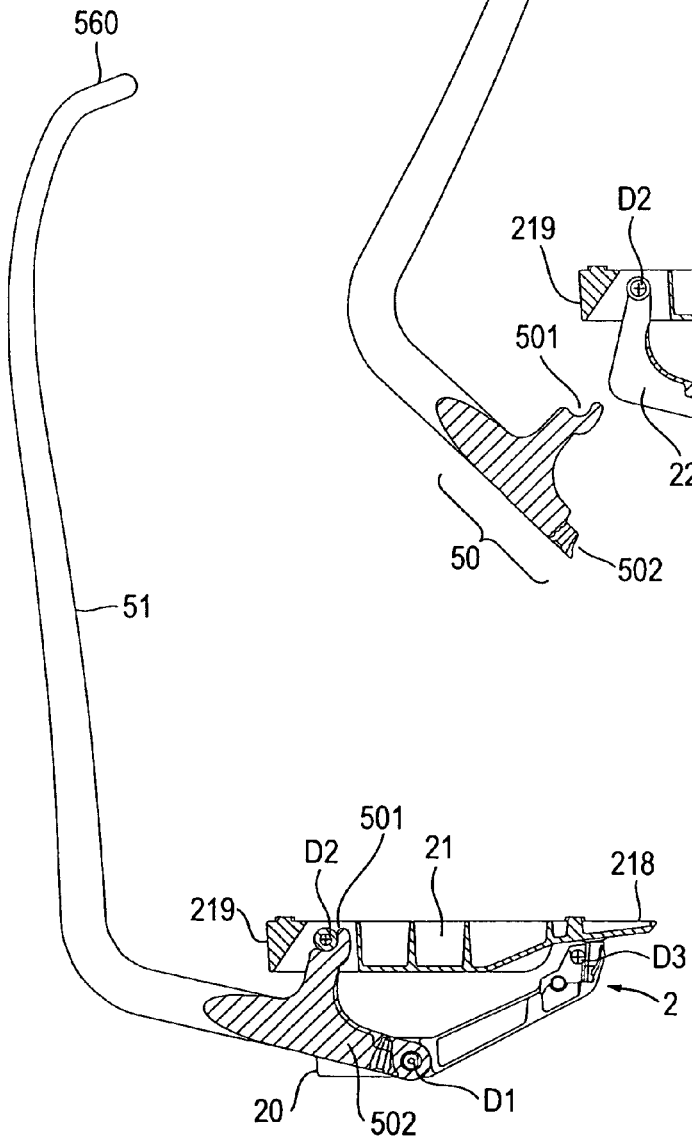
FIG. 2E depicts the representation in principle in accordance with FIG. 2D with the complete mechanism and the lateral brace completely suspended therein, as a vertical partial section.
Figure 3A:
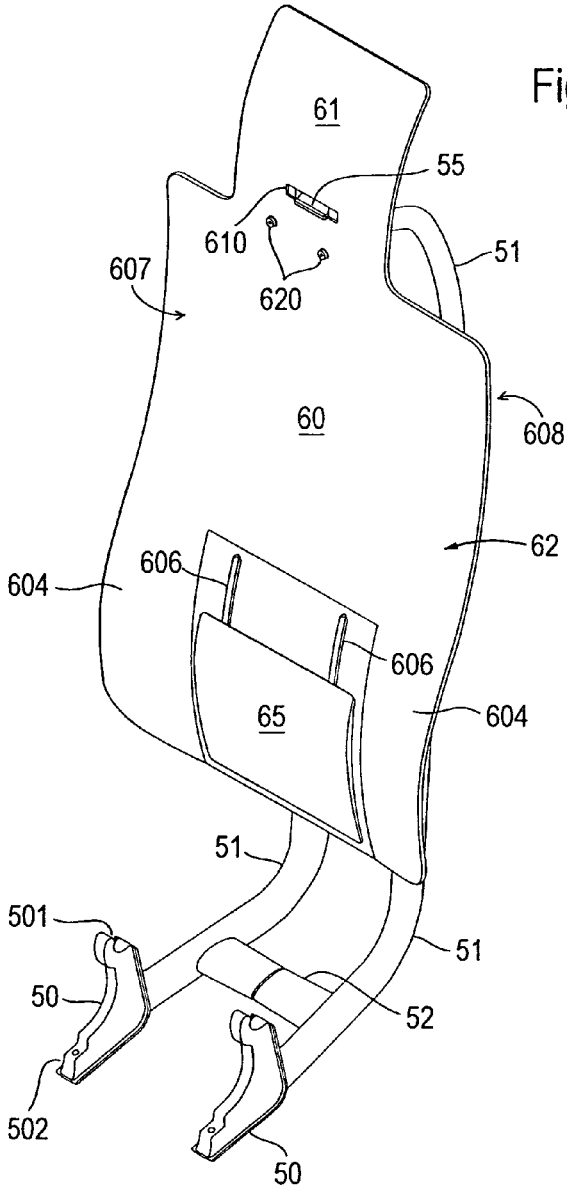
FIG. 3A depicts a backrest in FIG. 1B, without the covering, as a perspective view from the front.
Figure 3B:
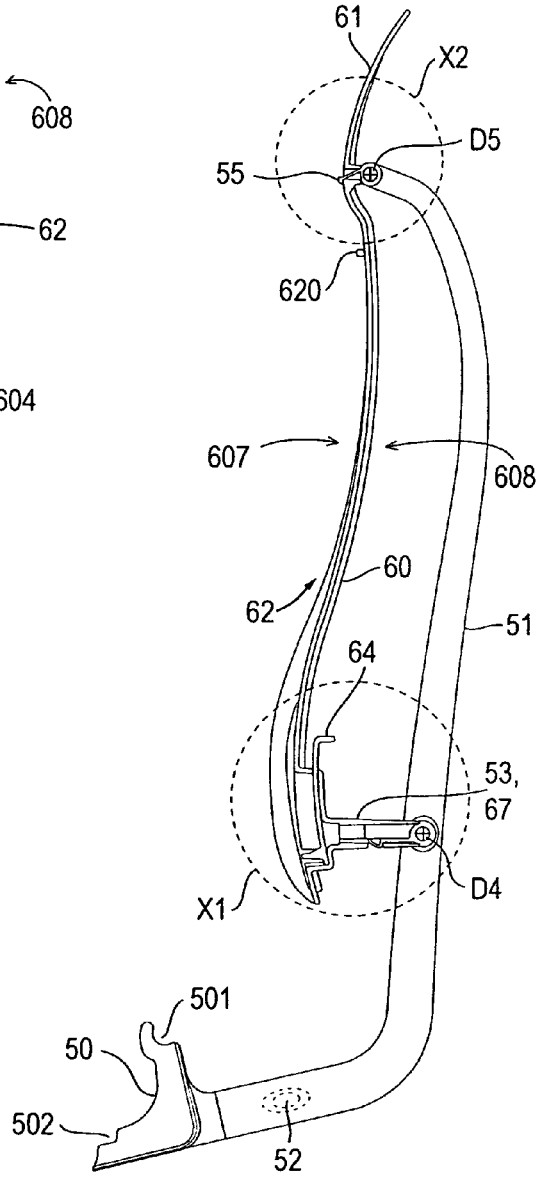
FIG. 3B depicts the backrest in accordance with FIG. 3A, as a side view.
Figure 3C:
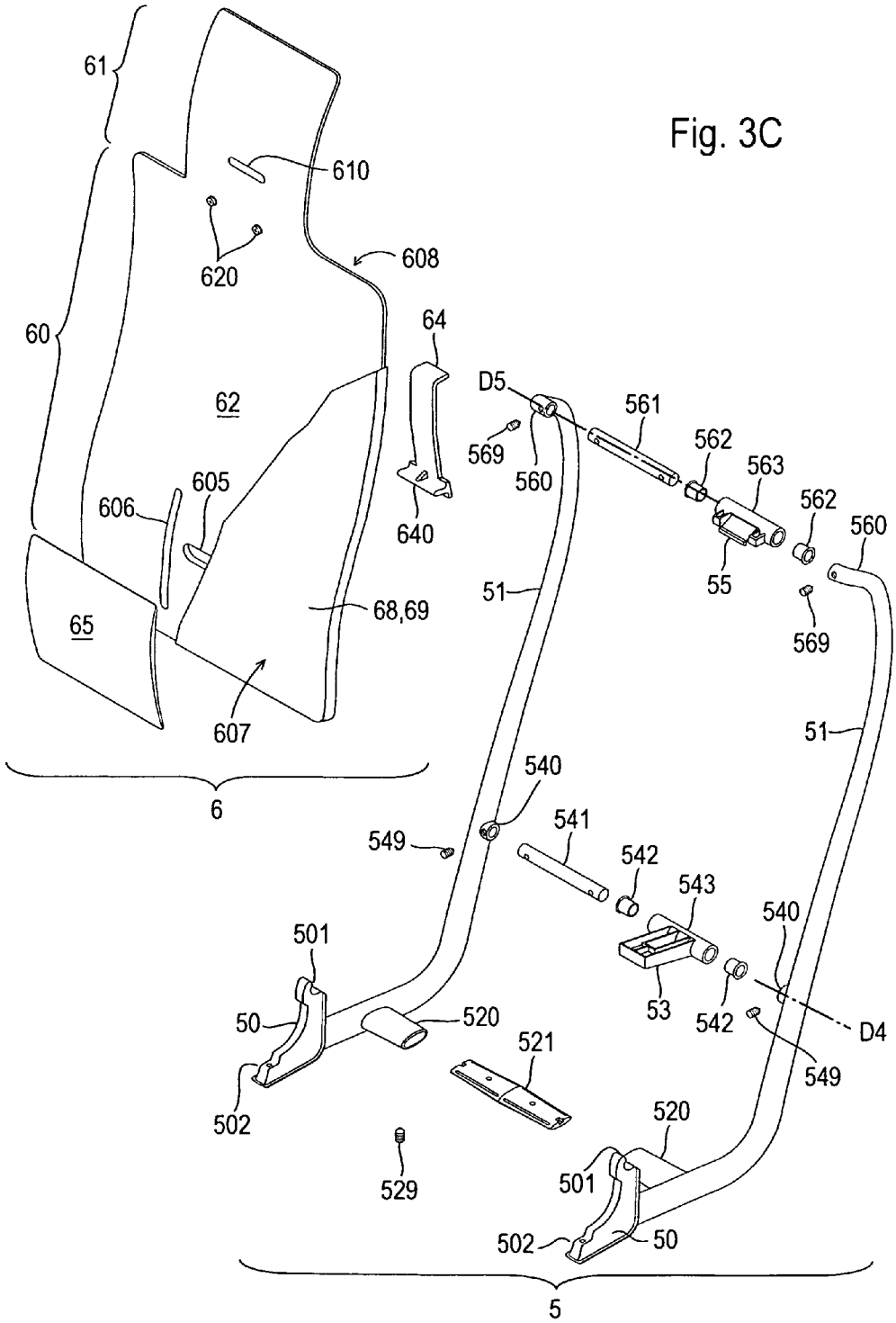
FIG. 3C depicts the backrest in accordance with FIG. 3A, with the covering of the backrest part illustrated, as a perspective exploded view.
Figure 3D:
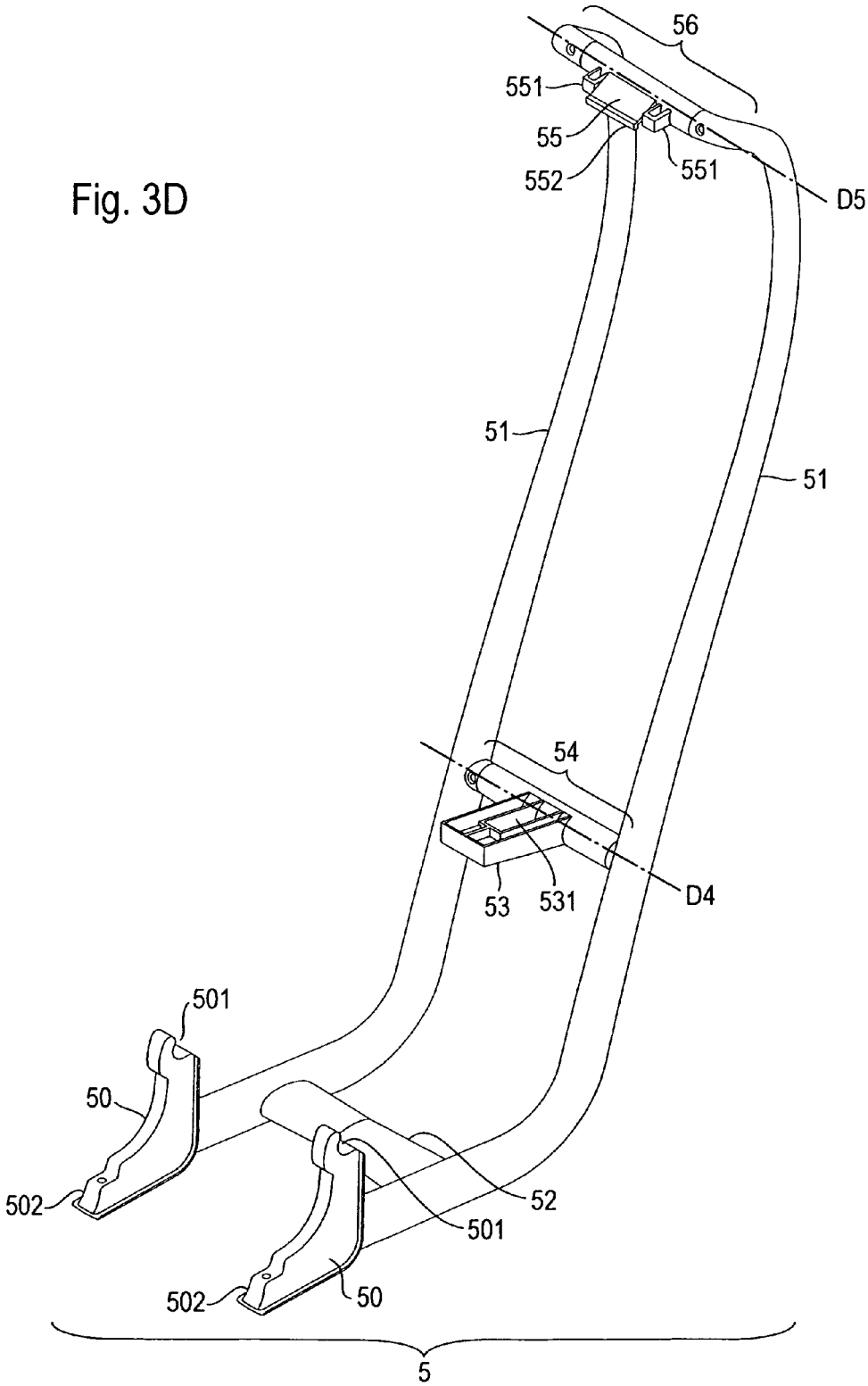
FIG. 3D depicts the backrest frame in FIG. 3C, assembled, as a perspective view from the front.
Figure 3E:
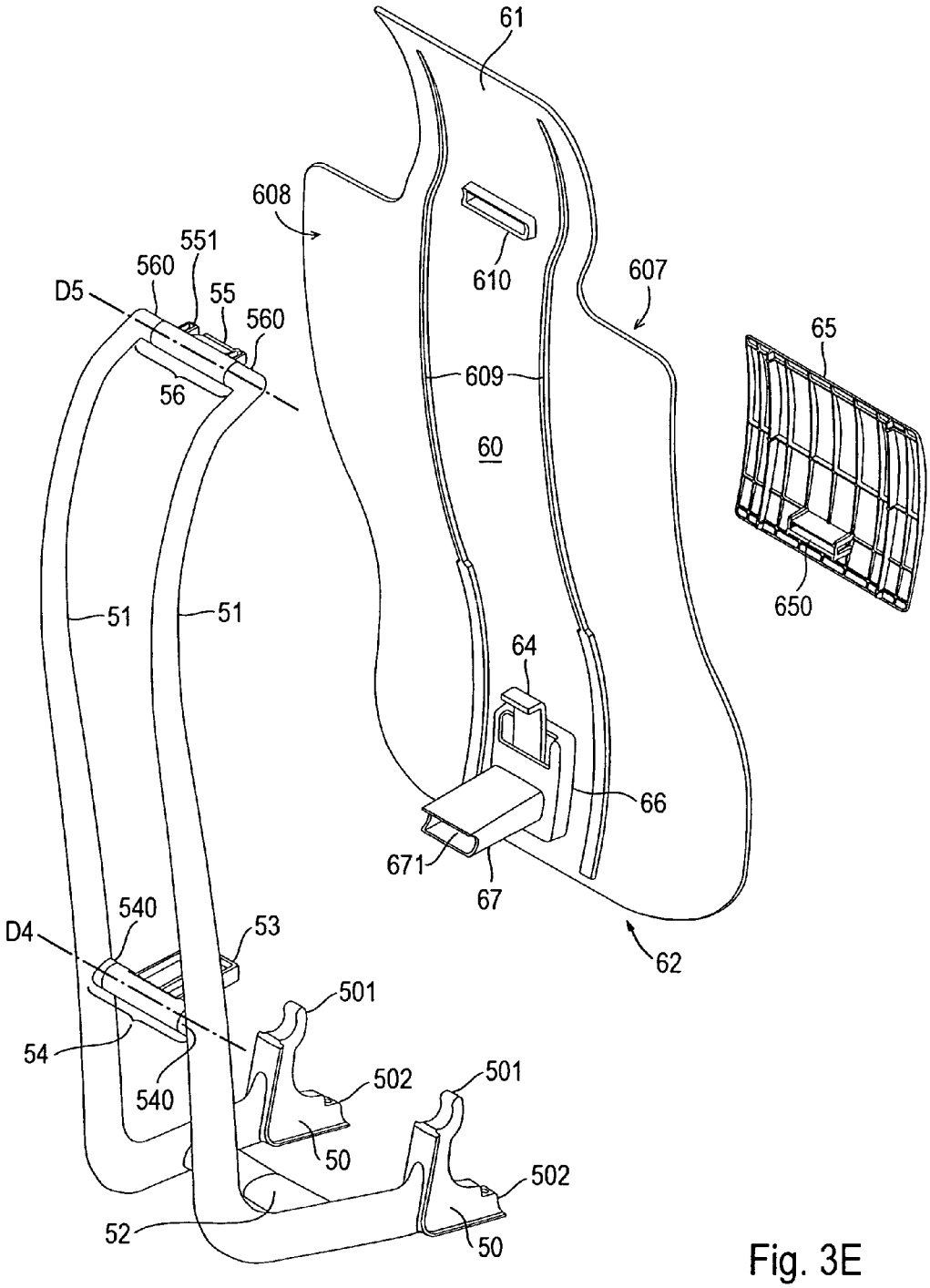
FIG. 3E depicts the backrest frame in accordance with FIG. 3D as a perspective view from the rear, and with a backrest part and a separate lumbar support in the vicinity.
Figure 3H:
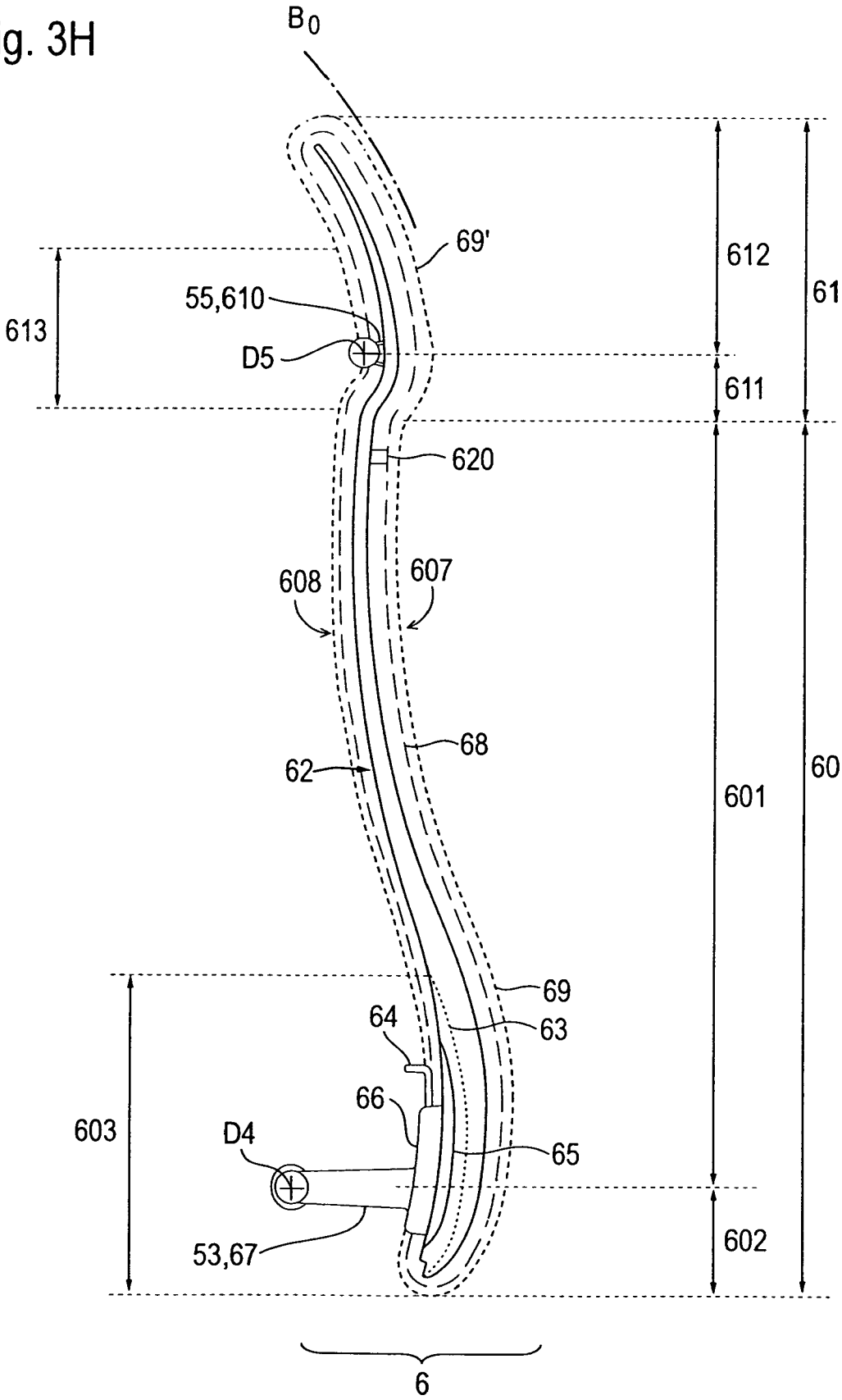
FIG. 3H depicts an enlarged view of the backrest part in FIG. 1C, with subdivision into sections, in the upright neutral position.
Figure 3J:
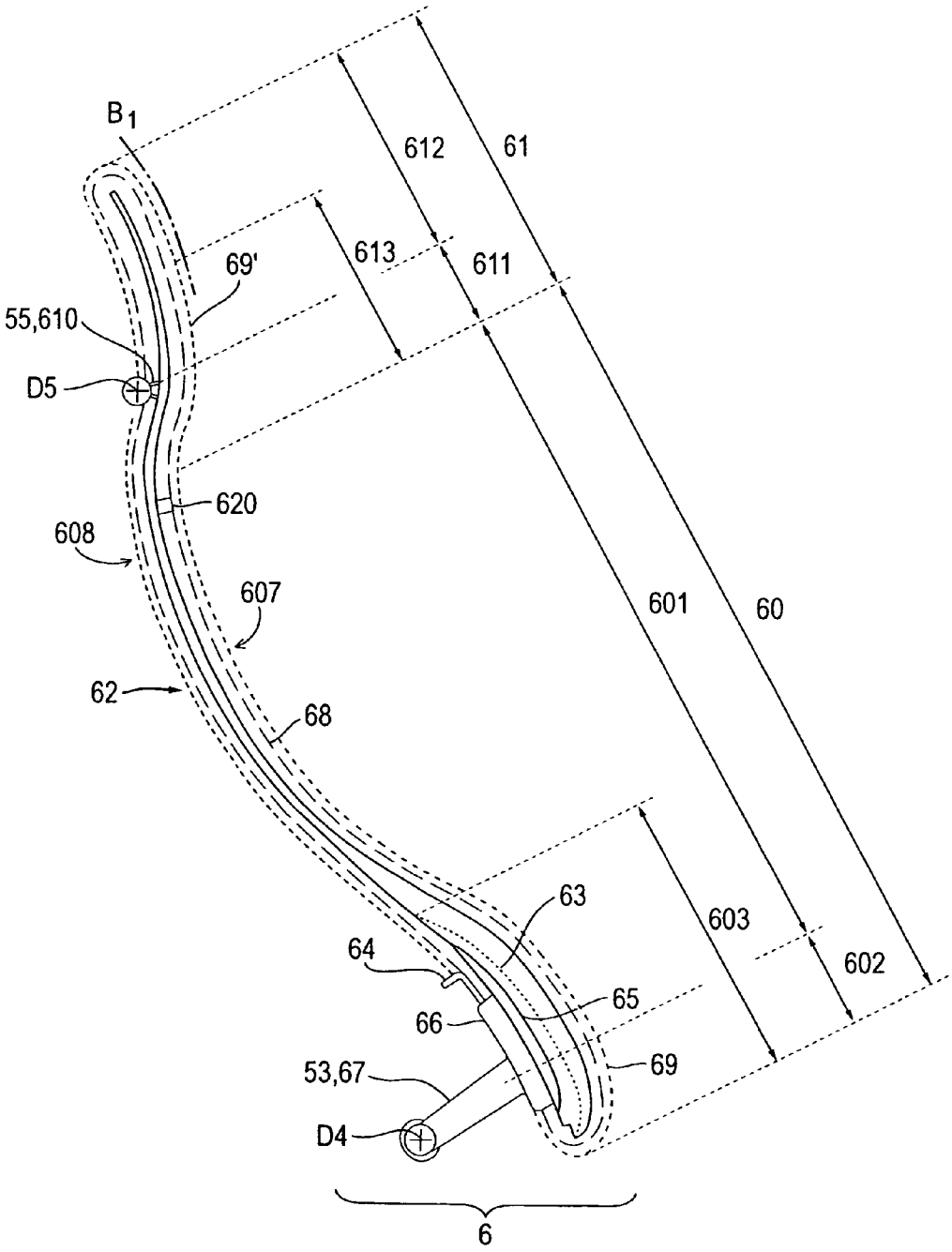
FIG. 3J depicts an enlarged view of the backrest part in FIG. 1E, with subdivision into sections, in the maximum reclined position.

FIGS. 2C to 2E

The lateral braces 51 possess an inward-facing connecting piece 520 close to the prolongations 50 in each case and a further connecting piece 540,560 in each case on the fourth and fifth pivot shaft D4,D5. When suspending the backrest frame 5 on the mechanism 2, the first, hook-shaped retaining contours 501 of the prolongations 50 are offered up in the angled state to the second pivot shaft D2, and the backrest frame 5 is caused to pivot so that the second retaining contours 502 arrive at the first pivot shaft D1, where a screwed connection is effected.

FIGS. 3A to 3L

Both lateral braces 51 are connected to the backrest frame 5 on the transverse strut 52 of the central transverse brace 54 and on the upper transverse strut 56, in conjunction with which the prolongations 50 are caused to lie at the lower ends of the lateral braces 51. The back panel 62 is detachably docked to the backrest frame 5. Present on the front side 607 in the lumbar area 603 are two vertically oriented slots 606, in which the panel-shaped lumbar support 65 is guided in such a way as to be capable of vertical displacement. The lateral flanks 604 possess a bending tendency to engage around the thigh part of the user. The back panel 62 is structured in the form of the back part 60 and the head restraint 61 that is attached thereto at the top, present in which is the fourth docking part 610 that is connected to the third docking part 55. Underneath this, two securing elements 620 project upwards from the front side 607 for the detachable attachment of the covering 69' for the head restraint 61.

The lower connecting pieces 520 are attached to one another by means of a bridging piece 521 inserted therein and are secured by means of screws 529. The central transverse brace 54, through which the fourth pivot shaft D4 extends, comprises the connecting pieces 540, a shaft rod 541, the preformed part 543 pushed thereon and the bearing shells 542. Screws 549 are used to hold the transverse brace 54 together. The first docking part 53, which possesses locking devices 531, extends from the rotatably mounted first preformed part 543. The upper transverse brace 56, through which the fifth pivot shaft D5 extends, comprises the connecting pieces 560, a shaft rod 561, the second preformed part 563 pushed thereon and the bearing shells 562. Screws 569 are used to hold the transverse brace 56 together. The third docking part 55, which possesses locking devices 551,552, extends from the rotatably mounted first preformed part 563.

In the assembled state, the third docking part 55 projects into the fourth docking part 610 and is secured by the locking devices 551,552. Arranged on the rear side 608 of the back panel 62 in the lumbar area 603 is a cell 66 to accept an adjusting lever 64, which engages with its carrier 640 in a carrier 650 for the lumbar support 65 and is utilized for its displacement. A second docking part 67 with locking devices 671 present therein to accept the first docking part 53 with its locking devices 531 projects from the cell 66. The fourth docking part 610 also projects from the rear side 608 from the neck area 613. Extending on the rear side 608 on both sides of the cell 66 and the fourth docking part 610 are reinforcing ribs 609, in which the vertical slots 606 run. The second docking part 67 and the fourth docking part 610 discharge as openings 605,610 on the front side 607. The back panel 62 is enclosed by a covering 68, which preferably consists of foamed plastic. Before foaming, the inserted lumbar support 65 is lined with a separating film 63 in order to maintain the displacement of the lumbar support 65. A cover 69, for example made of knitted fabric or leather, is drawn over the covering 68.

The back panel 62 is subdivided into the back part 60 and the head restraint 61 that is attached above it. Beneath the fourth docking part 610 lies a first section 611, and above it a second section 612, which first section 611 forms the neck area 613 together with an adjacent portion of the second section 612. Beneath the second docking part 67 lies a second section 602, and above it the first section 601, which second section 602 forms the lumbar area 603 together with an adjacent portion of the first section 601.

If a user pushes against the backrest 7 with his body weight, in particular above the lumbar area 603, the backrest will be displaced as far as the maximum reclined position $B_1$ in conjunction with elastic deformation of the back part 60, primarily above the lumbar area 603 and into the free intermediate space for the backrest frame 5, with an in principle concave tendency to the back of the user. Depending on the intensity of the pressure exerted against the back part 60, an opposing raising of the shoulder area is caused to occur, as a transitional zone of the back part 60 for the head restraint 61, and of the head restraint 61. In conjunction with this, the connections formed by the first and second docking parts 53,67 are caused to pivot upwards about the fourth pivot shaft D4, and the connections formed by the third and fourth docking parts 55,610 are caused to pivot downwards about the fifth pivot shaft D5.

The invention claimed is:

1. A chair with:

a) a sub frame (1) set on a floor;

b) a mechanism (2) set on the sub frame (1);

c) a seat (3) set on the mechanism (2); and d) a backrest (7) attached to the mechanism (2), the backrest (7) including a backrest frame (5) and an elastically deformable backrest part (6) having a back panel (62) with a head restraint (61), the back panel (62) having a back part (60) attached to the head restraint (61), the backrest frame (5) supporting the elastically deformable backrest part (6), the back part (60) and the head restraint (61) of the back panel (62) blending uniformly into one another, the head restraint (61) being divided into a lower, first head section (611), which fits onto the back part (60), and an upper, second head section (612), the first head section (611) and an adjacent portion of the second head section (612) forming a neck area (613), the back part (60) being divided into an upper, first back section (601), which fits onto the neck area (613), and a lower, second back section (602), the second back section (602) and an adjacent portion of the first back section (601) forming a lumbar area (603), the back part (60) being capable of pivoting about a first pivot shaft (D1) from an essentially upright, neutral position ($B_0$) to a reclined position ($B_1$), the seat (3) and the backrest (7) sized to move synchronically with the back part (60) when said back part (60) is moved toward the reclined position ($B_1$), lower means (53, 67, D4) and upper means (55, 610, D5) are provided to allow the head restraint (61) to pivot in a direction opposite to the reclined position ($B_1$) as the back part (60) moves to the reclined position ($B_1$), the lower means including a lower docking part (67) provided in the lumbar area (603), a lower pivot shaft (D4) extending through the backrest frame (5), the lower pivot shaft (D4) lying on a level with the lumbar area (603) in a vertical sense, and on which a first preformed part (543) with a first docking part (53) is articulated, the first docking part (53) being attached to the lower docking part (67), and the upper means including an upper docking part (610) provided in the neck area (613), and an upper pivot shaft (D5) lying on a level with the neck area (613) in a vertical sense and on which a second preformed part (563) with a second docking part (55) is articulated; the second docking part (55) being attached to the upper docking part (610).

2. The chair as claimed in claim 1, wherein the backrest frame (5) is rigid and includes a) two lateral braces (51), in each case with a prolongation (50) on their lower ends, and b) as connections between the lateral braces (51);

ba) a transverse strut (52) arranged close to the prolongations (50);

bb) a central transverse brace (54), through which the lower pivot shaft (D4) extends with the first preformed part (543) articulated with the central transverse brace (54); and bc) an upper transverse strut (56), through which the upper pivot shaft (D5) extends with the second preformed part (563) articulated with the upper transverse strut (56).

3. The chair as claimed in claim 2, wherein a) the transverse strut (52) in each case consists of a connecting piece (520) extending from the associated lateral brace (51) and a bridging piece (521) which engages into both of the mutually aligned connecting pieces (520);

b) the central transverse brace (54) in each case consists of a connecting piece (540) extending from the associated lateral brace (51) and an axle rod (541) which engages into both of the mutually aligned connecting pieces (540) and carries the first preformed part (543); and c) the upper transverse brace (56) in each case consists of a prolongation (560) extending from the associated lateral brace (51) and an axle rod (561) which engages into both of the mutually aligned prolongations (560) and carries the second preformed part (563).

4. The chair as claimed in claim 3, wherein the first docking part (53) and the lower docking part (67), and the second docking part (55) and the upper docking part (610), are detachably attached to one another by means of locking devices (531,671;551,552).

5. The chair as claimed in claim 4, wherein a) the first docking part (53) and the second docking part (55) are embodied as push-in elements; and b) the lower docking part (67) and the upper docking part (610) are embodied as sleeves which extend from the rear side (608) of the back panel (62).

6. The chair as claimed in claim 5, wherein a) a lumbar support (65) that is capable of vertical displacement is arranged in the lower area of the back panel (62) on its front side (607);

b) strengthening ribs (609) and a cell (66) intended to accept an adjusting lever (64) for the adjustment of the lumbar support (65) are provided on the rear side (608) of the back panel (62); and c) vertical slots (606) for guiding the lumbar support (65) are present on the front side (607) of the back panel (62), which vertical slots (606) follow the course of the strengthening ribs (609) and extend over the lumbar area (603).

7. The chair as claimed in claim 6, wherein a) the mechanism (2) consists of a fixed base (20) set on the sub frame (1) and a seat carrier (21) attached to the base (20);

b) the seat carrier (21) is attached to the base (20), on:

ba) the first fixed pivot shaft (D1);

bb) a second moving pivot shaft (D2), which faces towards a rear edge (31) of the seat;

bc) a third moving pivot shaft (D3), which faces towards a front edge (30) of the seat;

c) the prolongation (50) of the backrest frame (5) in each case is attached to a frame connection (22) in each case, which is articulated with the first pivot shaft (D1) on the one hand and with the second pivot shaft (D2) on the other hand; and d) in the mechanism (2), a spring subassembly (211) generates a pretension, which endeavors to retain the backrest (7) in the upright, neutral position ($B_0$).

8. The chair as claimed in claim 7, wherein a) the back panel (62) consists of plastic;

b) the lumbar area (603) of the back panel (62) possesses outer flanks (604) contoured to partially wrap around the user; and c) the head restraint (61) exhibits a curvature in its vertical cross section with a tendency to present an essentially convex surface to the user; and d) the upper pivot shaft (D5) is generally parallel to the front edge (30) of the seat and positioned forward of an upper edge of the head restraint (61) and positioned forward of the lower pivot shaft (D4).

9. The chair as claimed in claim 8, wherein a) the back panel (62) is surrounded by a covering (68); and b) the covering (68) is covered by a cover (69,69'); in conjunction with which c) the cover (69') for the head restraint (61) takes the form of a separate, replaceable part.

* * * * *